US010663183B1

(12) United States Patent
Stewart

(10) Patent No.: US 10,663,183 B1
(45) Date of Patent: May 26, 2020

(54) SMOKERS MODULE

(71) Applicant: Johnny Stewart, Daly City, CA (US)

(72) Inventor: Johnny Stewart, Daly City, CA (US)

( * ) Notice: Subject to any disclaimer, the term of this patent is extended or adjusted under 35 U.S.C. 154(b) by 249 days.

(21) Appl. No.: 15/877,501

(22) Filed: Jan. 23, 2018

(51) Int. Cl.
*F24F 3/16* (2006.01)
*E04H 1/12* (2006.01)
*B08B 15/02* (2006.01)

(52) U.S. Cl.
CPC ..... *F24F 3/1607* (2013.01); *B08B 15/02* (2013.01); *E04H 1/12* (2013.01); *E04H 2001/1294* (2013.01)

(58) Field of Classification Search
CPC ... E04H 2001/1294; F24F 3/1607; F24F 3/02; F24F 3/024; F24F 3/06; F24F 2003/1646; B05B 16/60
USPC ..... 454/50, 51, 52, 53, 54, 55
See application file for complete search history.

(56) References Cited

U.S. PATENT DOCUMENTS 5,085,134 A 2/1992 Hofstra
D346,437 S 4/1994 Poblete
5,389,035 A * 2/1995 Ishida ..... B61D 27/0018 454/115
5,472,466 A 12/1995 Oler
5,537,787 A 7/1996 Abraham
5,778,607 A 7/1998 Edwards
7,147,553 B2 12/2006 Leask
2006/0292973 A1 12/2006 Brooks
2009/0088061 A1* 4/2009 Le Beau ..... F24F 3/1607 454/53
2009/0178687 A1 7/2009 Davis
2018/0333672 A1* 11/2018 Moulton ..... B01D 53/12

FOREIGN PATENT DOCUMENTS

EP 2161393 A2 * 3/2010 ..... E04H 1/1205
KR 20030043627 A * 6/2003

* cited by examiner

*Primary Examiner* — Steven B McAllister
*Assistant Examiner* — Charles R Brawner

(57) ABSTRACT

The smokers module comprises a smoking space and an air handling system. The air handling system processes the air within the smoking space. The air handling system further comprises a filter chain, an air exhaust, an air intake, and a plurality of fans. The plurality of fans recirculate the air contained within the smoking space for processing. Specifically, the plurality of fans: 1) pump air through the filter chain; 2) draws fresh air into the smoking space through the air intake; and, 3) discharges air from the smoking space into the atmosphere. The filter chain removes organic compounds, inorganic compounds, and radicals from air drawn from the smoking space. The air intake draws fresh air into the smokers module and the air exhaust discharges air from the smokers module into the atmosphere.

11 Claims, 5 Drawing Sheets

SMOKERS MODULE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of separating and mixing, more specifically, a chamber and apparatus for treating a fluid with a stationary solid sorbent.

This disclosure addresses cigarette smoke and second-hand smoke. The burning of a cigarette is a combustion reaction that releases gases, referred to as smoke, into the atmosphere. Generally, cigarette smoke is initially inhaled by a person and is then later exhaled in a form commonly called second-hand smoke. The nature of cigarette smoke comprises over one thousand identified chemical compounds. The compounds can be roughly classified as particulates, organic compounds, inorganic compounds, and radicals. Compounds within each of these classifications have chemically unique properties.

Particulates refer to small dust-like particles that are released into and remain suspended in the atmosphere by the combustion process.

Organic compounds are chemicals with a carbon base. The classification of organic compounds is well-known in the chemical arts. Organic compounds found in second-hand smoke include, but are not limited to, benzoantrhacene, benzopyrene, dibenznanthracene, N-nitrosonornicotine, N-nitrosopyrrolidine, 2-naphthylamine, 4-aminlbiphenyl, acetaldehyde, formaldehyde, benzene, isoprene, 1,3-butadiene, and toluene.

Inorganic compounds are those compounds that are not considered in the chemical arts as organic compounds. Inorganic compounds found in second-hand smoke include, but are not limited to, arsenic, cadmium, carbon monoxide, chromium, lead, nickel, and polonium.

Radicals are ionized molecules that are generated by the smoking process. While the combustion process generates radicals, there is evidence suggesting that many of the radicals generated by smoking are a result of chemical reactions that occur after the combustion process. Radicals include, but are not limited to, nitrogen dioxide, quinone, and hydroquinone.

Because of the addictive nature of cigarettes, these gases are continuously introduced into the atmosphere—especially in enclosed spaces. In addition, while a HEPA filter will remove particulates suspended in a gas, HEPA filters will not remove chemicals in a gas phase. Clearly, a method to more effectively remove second-hand smoke from an enclosed space would be of benefit to the health and well-being or non-smokers.

SUMMARY OF INVENTION

This disclosure addresses the above shortcoming in smoking cigarettes.

The smokers module is an enclosed chamber that is configured for use during cigarette smoking. The smokers module comprises a smoking space and an air handling system. The air handling system is an enhanced ventilation system that processes the air within the smoking space. The air handling system further comprises a filter chain, an air exhaust, an air intake, and a plurality of fans. A smoker goes into the smoking space to smoke a cigarette. The plurality of fans recirculate the air contained within the smoking space for processing. Specifically, the plurality of fans: 1) pump air through the filter chain; 2) draws fresh air into the smoking space through the air intake; and, 3) discharges air from the smoking space into the atmosphere. The filter chain removes particulates, organic compounds, inorganic compounds, and radicals from air drawn from the smoking space. The air intake draws fresh air into the smokers module. The air exhaust is a port from which air in the smoke space discharges into the atmosphere.

These together with additional objects, features and advantages of the smokers module will be readily apparent to those of ordinary skill in the art upon reading the following detailed description of the presently preferred, but nonetheless illustrative, embodiments when taken in conjunction with the accompanying drawings.

In this respect, before explaining the current embodiments of the smokers module in detail, it is to be understood that the smokers module is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the smokers module.

It is therefore important that the claims be regarded as including such equivalent construction insofar as they do not depart from the spirit and scope of the smokers module. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
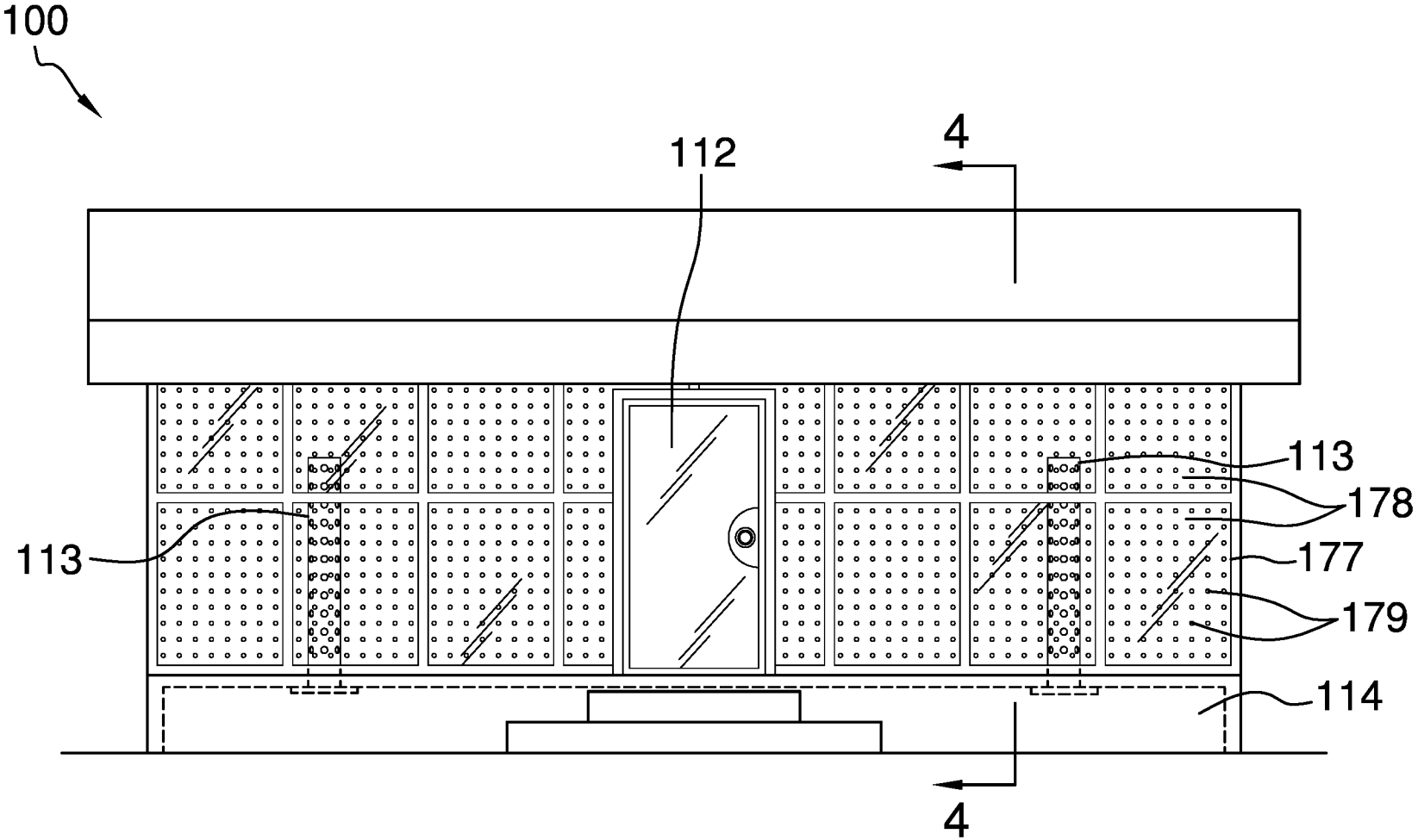
FIG. 1 is a front view of an embodiment of the disclosure.
Figure 2:
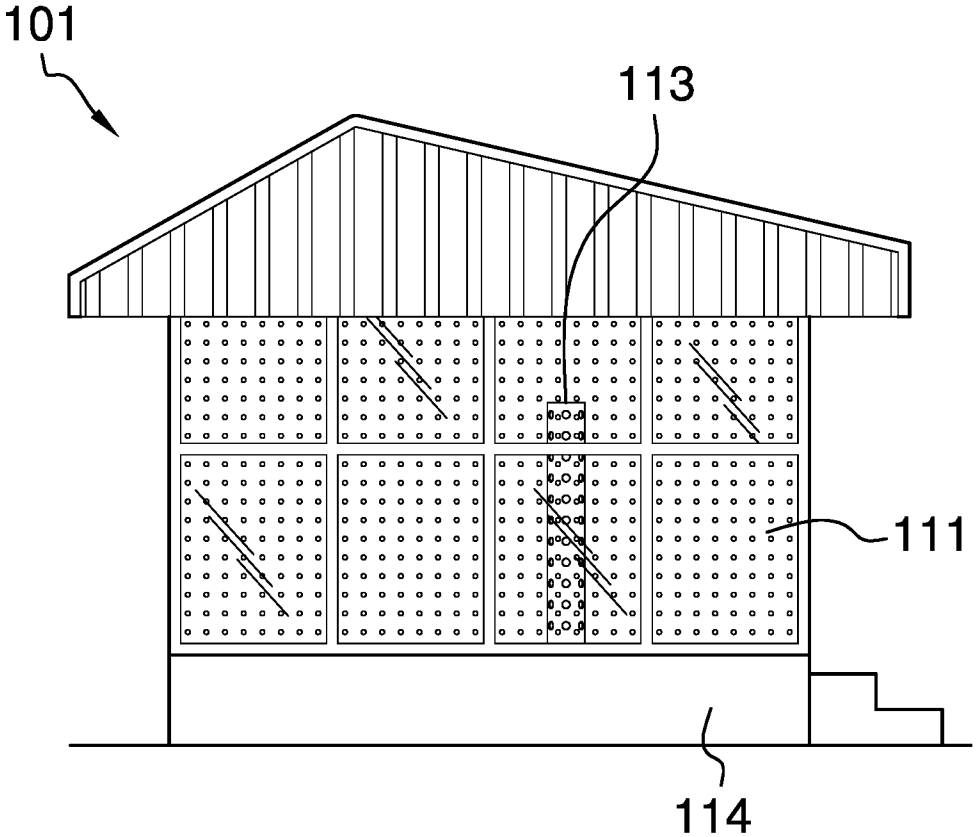
FIG. 2 is a side view of an embodiment of the disclosure.
Figure 3:
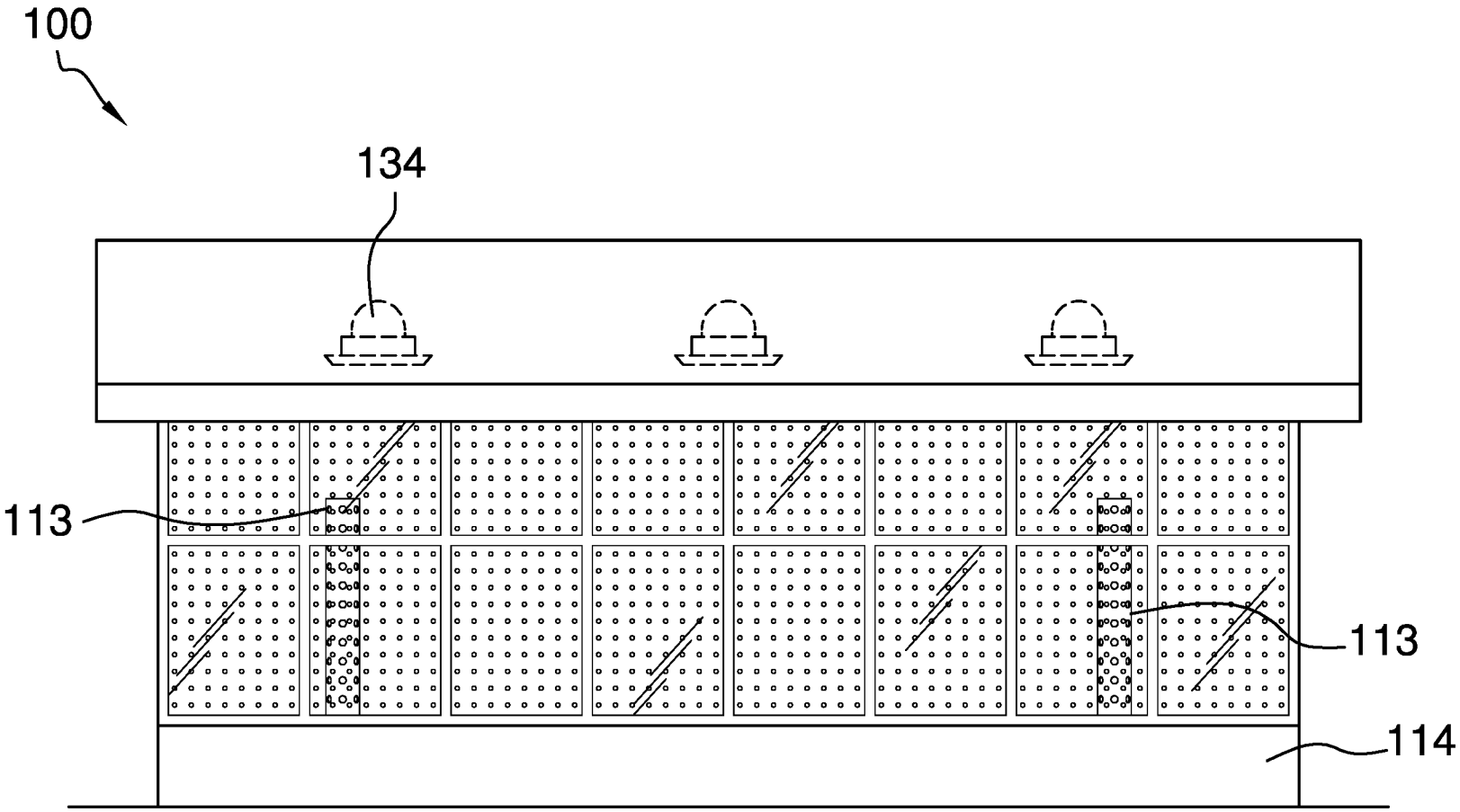
FIG. 3 is a top view of an embodiment of the disclosure.
Figure 4:
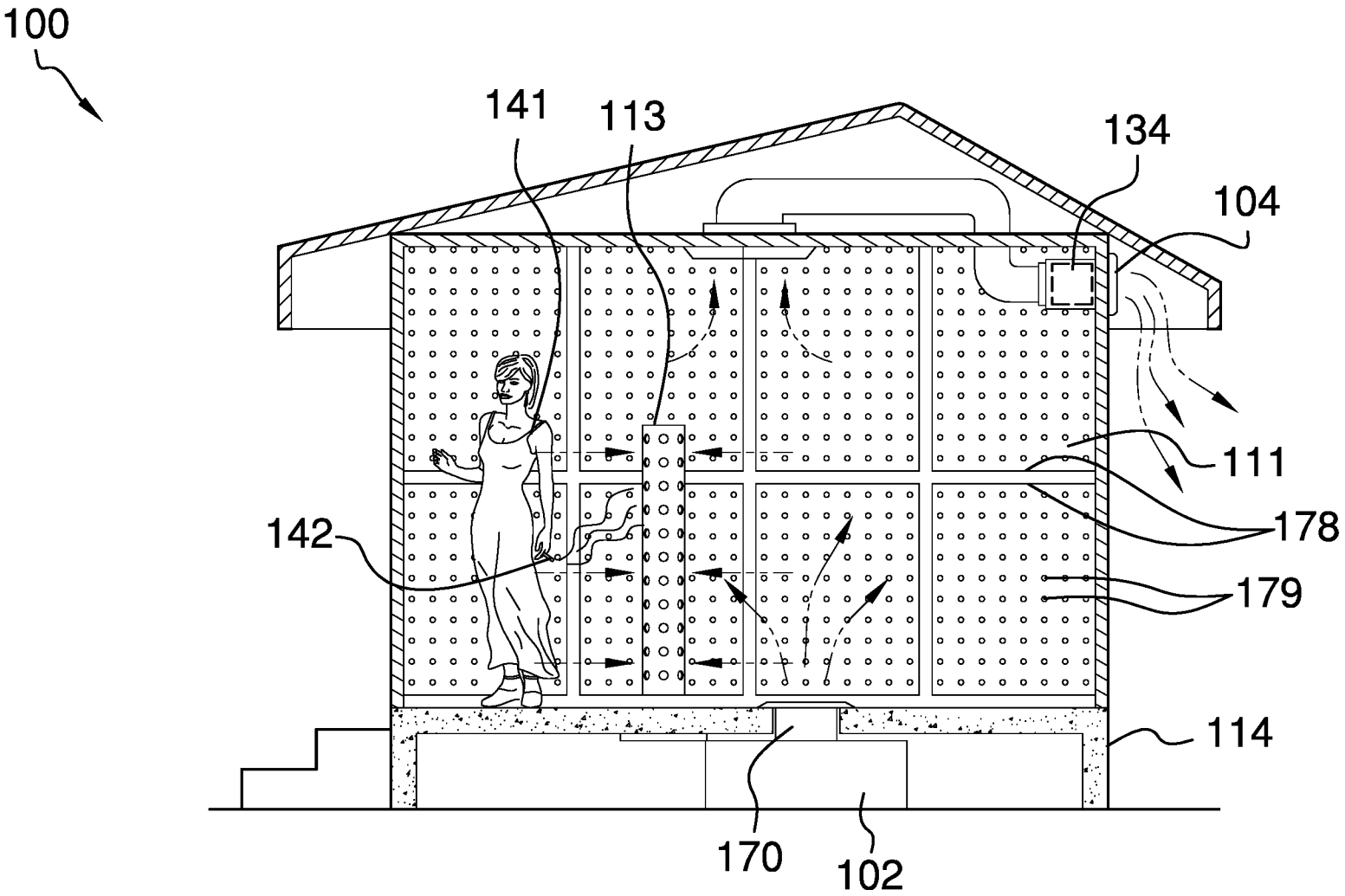
FIG. 4 is a cross-sectional view of an embodiment of the disclosure across 4-4 as shown in FIG. 1.
Figure 5:
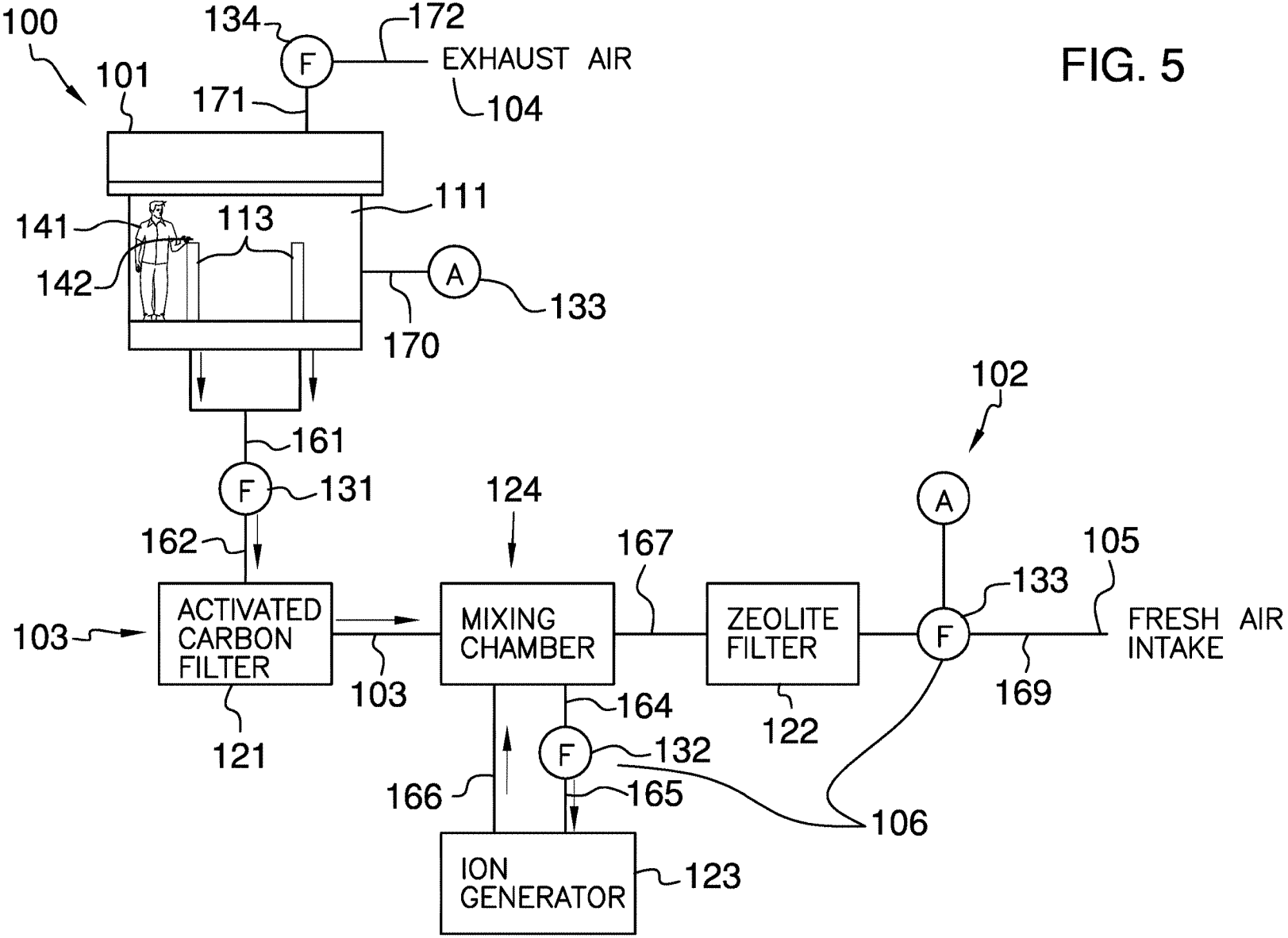
FIG. 5 is a schematic view of an embodiment of the disclosure.

Detailed reference will now be made to one or more potential embodiments of the disclosure, which are illustrated in FIGS. 1 through 5.

The smokers module 100 (hereinafter invention) is an enclosed chamber that is configured for use by a smoker 141 during cigarette 142 smoking. The smoker 141 is an individual who smokes the cigarette 142. The cigarette 142 is a commercially available combustible product. The invention 100 comprises a smoking space 101 and an air handling system 102.

The smoking space 101 is an enclosed room-sized chamber. The smoker 141 enters the smoking space 101 to smoke a cigarette 142. The smoking space 101 traps the smoke generated by the smoker 141 while smoking the cigarette 142. While the smoking space 101 can tolerate some leakage, the intent of the smoking space 101 is to contain second-hand smoke generated by the smoking of a cigarette 142. The smoking space 101 can be stationary or portable. The smoking space 101 may or may not have transparent walls. The smoking space 101 comprises an enclosed space 111, an entrance 112, a plurality of intake stanchions 113, and a raised floor 114.

The enclosed space 111 forms the boundaries of the chamber within which the smoker 141 smokes a cigarette 142. The enclosed space 111 physically contains the smoke generated by the cigarette 142 within the smoking space 101. The enclosed space 111 comprises a plurality of walls 177 and a roof. The entrance 112 is a door that allows for access into and out of a smoking space 101. The entrance 112 may or may not have a vestibule to keep gas within the smoking space 101.

Each of the plurality of walls 177 of the enclosed space 101 may be comprised of a plurality of wall panels 178. Each of the plurality of wall panels 178 includes a plurality of panel holes 179 thereon. The plurality of panel holes 179 enables fresh air from outside of the smoking space 101 to enter the enclosed space 111.

Each of the plurality of intake stanchions 113 is a hollow prism structure that mounts on the raised floor 114 such that each of the plurality of intake stanchions 113 projects perpendicularly away from the raised floor 114. The lateral face of each of the plurality of intake stanchions 113 forms a foraminous surface through which gas can flow. Each of the plurality of intake stanchions 113 forms a pipe through which gas is drawn from the smoking space 101 into the air handling system 102.

The raised floor 114 is a horizontal surface positioned above the supporting surface on which the smoking space 101 rests. The raised floor 114 creates a space between the supporting surface and the smoking space 101 in which the air handling system 102 is contained.

The air handling system 102 is an enhanced ventilation system that processes the air within the smoking space 101. The air handling system 102 further comprises a filter chain 103, an air exhaust 104, an air intake 105, and a plurality of fans 106. The plurality of fans 106 recirculate the air contained within the smoking space 101 for processing. Specifically, the plurality of fans 106: 1) pump air through the filter chain 103; 2) draws fresh air into the smoking space through the air intake 105; and, 3) discharges air from the smoking space 101 into the atmosphere. The filter chain 103 removes particulates, organic compounds, inorganic compounds, and radicals from air drawn from the smoking space 101. The air intake 105 is a port that draws fresh air into the invention 100. The air exhaust 104 is a port from which air in the smoke space discharges into the atmosphere.

The air exhaust 104 is a vent that discharges gas from within the smoking space 101 into the atmosphere outside of the smoking space 101. The air intake 105 is a vent draws that fresh air into smoking space 101 from the atmosphere outside of the smoking space 101.

The plurality of fans 106 pump gas through the invention 100. Specifically, each of the plurality of fans 106 performs a function selected from the group consisting of: 1) pumping gas through the air handling system 102; 2) pumping gas from the smoking space 101 into the atmosphere outside of the smoking space 101; and, 3) pumping fresh air into the smoking space 101 from the atmosphere outside of the smoking space 101. The plurality of fans 106 comprises an intake fan 131, a recirculation fan 132, a mixing fan 133, and an exhaust fan 134.

The filter chain 103 is an apparatus that removes the particulates, the organic compounds, the inorganic compounds, and the radicals from the gas contained within the smoking space 101. The filter chain 103 comprises an activated carbon filter 121, a zeolite filter 122, an ion generator 123, and a mixing chamber 124.

The activated carbon filter 121 is a bed filter formed using activated carbon. The plurality of fans 106 pumps gas drawn from the enclosed space 111 through the activated carbon filter 121. The activated carbon filter 121 adsorbs contaminants from the gas flowing through the activated carbon filter 121. The activated carbon filter 121 primarily adsorbs particulates and organic chemicals from the gas flow. The activated carbon filter 121 does not possess an ordered crystalline structure. The lack of a crystalline structure in the activated carbon filter 121 results in the activated carbon filter 121 having an irregular pore diameter ranging from 20 Angstrom to several thousand Angstrom. This variation in the pore diameter of the activated carbon filter 121 means that the activated carbon filter 121 will not reliably remove smaller molecules and atoms that pass through the activated carbon filter 121. Such compounds include, but are not limited to, arsenic, cadmium, chromium, lead, nickel, polonium, and many smaller organic compounds.

The zeolite filter 122 is a bed filter formed using a natural or artificial zeolite material. The plurality of fans pumps gas drawn from the enclosed space 111 through the zeolite filter 122. The zeolite filter 122 captures contaminants from the gas flowing through the zeolite filter 122 using both an ion exchange process and an adsorption process. The zeolite filter 122 primarily captures inorganic and polar chemicals from the gas flow. The zeolite filter 122 does possess an ordered crystalline structure. The crystalline structure of the zeolite filter 122 presents a consistent pore diameter of between 3 Angstrom and 10 Angstrom. The crystalline structure of the zeolite filter 122 makes the zeolite filter 122 a more reliable filter for the removal of elemental gases and small molecules than the activated carbon filter 121. The ion exchange process used by the zeolite filter 122 makes the zeolite filter 122 a more reliable filter for the removal of polar molecules than the activated carbon filter 121.

The ion generator 123 and the mixing chamber 124 are used in combination to remove radicals from the gas flow through the air handling system 102. The ion generator 123 and the mixing chamber 124 forms a recirculating fluidic circuit that releases ions into the gas flowing through the air handling system 102. The release of ions into the gas flow initiates a series of reduction-oxidization reactions that eliminate the radicals from the gas flow. The gas flowing through the air handling system 102 is pumped through the mixing chamber 124.

The ion generator 123 processes a gas subflow that is drawn from the gas flow as it passes through the mixing chamber 124. The ion generator 123 passes ultraviolet light through the gas subflow. The ultraviolet light primarily splits the water vapor contained in the gas subflow into a hydrogen ion and a hydroxyl. As the hydroxyl and the hydrogen ion flow back into the mixing chamber 124, these ions chemically react with the radicals in the gas flow thereby eliminating the radical from the gas flow. The ion generator 123 is a commercially available product that is also called an ozone generator. While any ozone produced by the ion generator 123 is of benefit to the disclosed process, it is anticipated the hydrogen and hydroxyl ions are more important to the process.

The intake fan 131 is a mechanical device that initiates the gas flow by pumping gas from the plurality of intake stanchions 113 into the activated carbon filter 121. The intake fan 131 is sized to pump the gas flow from the plurality of intake stanchions 113 through the activated carbon filter 121, the mixing chamber 124, and the zeolite filter 122 to the mixing fan 133.

The recirculation fan 132 is a mechanical device that generates the recirculation of the gas subflow between the mixing chamber 124 and the ion generator 123.

The mixing fan 133 is a mechanical device that: 1) receives the processed gas flow from the zeolite filter 122; 2) draws fresh air into the system from the air intake 105 and pumps the combination of the processed gas flow and the drawn fresh air back into the enclosed space 111.

The exhaust fan 134 pumps gas from the enclosed space 111 to the air exhaust 104 where it discharges into the atmosphere.

The following seven paragraphs describe the assembly of the first potential embodiment of the disclosure.

The air handling system 102 further comprises a first connection 161, a second connection 162, a third connection 163, a fourth connection 164, a fifth connection 165, a sixth connection 166, a seventh connection 167, an eighth connection 168, a ninth connection 169, a tenth connection 170, an eleventh connection 171, and a twelfth connection 172.

The first connection 161 is a commercially available duct. The second connection 162 is a commercially available duct. The third connection 163 is a commercially available duct. The fourth connection 164 is a commercially available duct. The fifth connection 165 is a commercially available duct. The sixth connection 166 is a commercially available duct. The seventh connection 167 is a commercially available duct. The eighth connection 168 is a commercially available duct. The ninth connection 169 is a commercially available duct. The tenth connection 170 is a commercially available duct. The eleventh connection 171 is a commercially available duct. The twelfth connection 172 is a commercially available duct.

The first connection 161 fluidly connects each of the plurality of intake stanchions 113 to the intake fan 131. The second connection 162 fluidly connects the intake fan 131 to the activated carbon filter 121. The third connection 163 fluidly connects the activated carbon filter 121 to the mixing chamber 124.

The fourth connection 164 fluidly connects the mixing chamber 124 to the recirculation fan 132. The fifth connection 165 fluidly connects the recirculation fan 132 to the ion generator 123. The sixth connection 166 fluidly connects the ion generator 123 to the mixing chamber 124 to complete the recirculation loop.

The seventh connection 167 fluidly connects the mixing chamber 124 to the zeolite filter 122. The eighth connection 168 fluidly connects the zeolite filter 122 to the mixing fan 133. The ninth connection 169 fluidly connects the air intake 105 to the mixing fan 133. The tenth connection 170 fluidly connects the mixing fan 133 to the enclosed space 111.

The eleventh connection 171 fluidly connects the enclosed space 111 to the exhaust fan 134. The twelfth connection 172 fluidly connects the exhaust fan 134 to the air exhaust 104.

In the first potential embodiment of the disclosure, the exhaust fan 134, the eleventh connection 171, and the twelfth connection 172 are located on the roof of the smoking space 101. The balance of the air handling system 102 is located underneath the raised floor 114 of the smoking space 101.

The following definitions were used in this disclosure:

Activated Carbon: As used in this disclosure, activated carbon is a form of carbon that presents a large surface area for chemical interactions. The surface of activated carbon is used to adsorb chemical contaminants from a fluid flow passed through the activated carbon.

Adsorption: As used in this disclosure, adsorption refers to the formation of a layer of molecules on a surface.

Anion: As used in this disclosure, an anion refers to a negatively charged ion.

Bed Filter: As used in this disclosure, a bed filter comprises a material through which a fluid passed such that the material captures chemicals and solids contained within the fluid while allowing the fluid itself pass through the bed filter.

Carbon Monoxide: As used in this disclosure, carbon monoxide (CAS 630-08-0) refers to a chemical compound with the formula CO.

Cation: As used in this disclosure, a cation refers to a positively charged ion.

Door: As used in this disclosure, a door is a movable or removable barrier that is attached to the wall of a room or the surface of a container for the purpose of allowing or preventing access through an aperture into the room or container.

Duct: As used in this disclosure, a duct is a tube, pipe, canal or channel through which a gas is conducted or conveyed.

Fan: As used in this disclosure, a fan is a pump that moves a gas.

Filter: As used in this disclosure, a filter is a mechanical device that is used to separate solids that are suspended in a liquid or a gas. A strainer is a type of filter with what would be considered a coarse mesh measurement.

Fluid: As used in this disclosure, a fluid refers to a state of matter wherein the matter is capable of flow and takes the shape of a container it is placed within. The term fluid commonly refers to a liquid or a gas.

Foraminous: As used in this disclosure, foraminous is an adjective that describes a surface, plate, or platform perforated with a plurality of holes.

Functional Group: As used in this disclosure, a functional group is a specific chemical structure that 1) defines the structure of a chemical family; and, 2) determines the properties of the chemical family. Common functional groups include, but are not limited to, aldehydes, alkanes, alkenes, alkynes, alcohols, amides, amines, carboxylic acids, esters, ethers, haloalkanes, haloalkenes, haloalkynes, and ketones. As a practical matter, this definition intends to use the term functional group in the same manner as the term is commonly used in organic chemistry.

Gas: As used in this disclosure, a gas refers to a state (phase) of matter that is fluid and that fills the volume of the structure that contains it. Stated differently, the volume of a gas always equals the volume of its container.

HEPA: As used in this disclosure, a HEPA filter is a filter that meets standards set by the United States Department of Energy. The HEPA standard defines several classes of filters that are primarily differentiated by the percentage of 0.3 micrometer particles that the filter will remove from the air that passes through the filter. HEPA is an acronym that stands for high-efficiency particulate arrestor.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hydroxyl: As used in this disclosure, a hydroxyl refers to a functional group comprising the chemical formulation OH. The hydroxyl is the primary functional group that forms alcohols. When unbonded, the hydroxyl is considered an ion and is considered to be a radical.

Ion: As used in this disclosure, an ion is an atom or a molecule with a net electric charge.

Liquid: As used in this disclosure, a liquid refers to a state (phase) of matter that is fluid and that maintains, for a given pressure, a fixed volume that is independent of the volume of the container.

Metal: As used in this disclosure, a metal is an element that readily loses electrons or an alloy formed from a plurality of such elements. General properties of metals include, but are not limited to, the ability to conduct electricity, malleability, and the ability to be drawn into a wire. For the purposes of this disclosure, the term metal refers to the elements in columns 1-12 of the periodic table and aluminum, tin, and lead.

Nitrogen Dioxide: As used in this disclosure, nitrogen dioxide (CAS 10102-44-0) refers to a chemical compound with the formula NO2.

Ozone: As used in this disclosure, ozone (CAS 10028-15-6) refers to a chemical compound with the formula O3.

Prism: As used in this disclosure, a prism is a 3-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump dedicated to compressing a fluid or placing a fluid under pressure.

Radical: As used in this disclosure, an atom or molecule is a radical if it contains an odd or unpaired electron. The atom or molecule that forms the radical may or may not be charged.

Solid: As used in this disclosure, a solid refers to a state (phase) of matter that: 1) has a fixed volume; and, 2) does not flow.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Surface Filter: As used in this disclosure, a surface filter is a type of filter wherein the fluid is passed through a surface or membrane, such as a screen or paper that allows for the passage of the fluid but blocks the passage of larger particles that may be suspended in the fluid. The construction of a surface filter would allow for the passage of the fluid through several filter surfaces in one filtration unit.

Suspension: As used in this disclosure, a suspension is a heterogeneous mixture containing items that will separate, often through sedimentation, over time.

Transparent: As used in this disclosure, transparent refers to a material that allows light to pass through the material without significant scattering such that an object can be clearly seen through the material.

Vent: As used in this disclosure, a vent is an opening in the structure that allows for the flow of gas through the boundary of the structure.

Vestibule: As used in this disclosure, a vestibule refers to a chamber located in front of a door.

Zeolite: As used in this disclosure, a zeolite is any of a group of anhydrous aluminum silicate, or their corresponding synthetic compounds, that are used as molecular filters and ion exchange agents.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An apparatus comprising:

a chamber comprising a smoking space, and an air handling system;

wherein the air handling system is a ventilation system that processes the air within the smoking space;

wherein the apparatus is configured for use by a smoker during cigarette smoking;

wherein the cigarette is a combustible product; wherein the smoker smokes the cigarette in the chamber;

wherein the air handling system removes combustion byproducts from the air in the chamber;

wherein the air handling system further comprises a filter chain, an air exhaust, an air intake, and a plurality of fans;

wherein the filter chain removes particulates, organic compounds, inorganic compounds, and radicals from the air drawn from the smoking space;

wherein the air intake is a port that draws fresh air into the apparatus;

wherein the air exhaust is a port from which air in the smoking space discharges into the atmosphere;

wherein the plurality of fans pump gas through the apparatus;

wherein the filter chain removes the particulates, the organic compounds, the inorganic compounds, and the radicals from the gas contained within the smoking space;

wherein the filter chain comprises an activated carbon filter, a zeolite filter, an ion generator, and a mixing chamber; wherein the activated carbon filter, the zeolite filter, the ion generator, and the mixing chamber are fluidly interconnected;

wherein the activated carbon filter is a bed filter;

wherein the activated carbon filter is formed using activated carbon;

wherein the activated carbon filter has a non-crystalline structure;

wherein the activated carbon filter processes a gas flow drawn from the smoking space;

wherein the zeolite filter is a bed filter;

wherein the zeolite filter is formed using a zeolite material selected from the group consisting of a natural zeolite and an artificial zeolite;

wherein the zeolite filter has an ordered crystalline structure;

wherein the zeolite filter processes the gas flow drawn from the smoking space;

wherein the ion generator and the mixing chamber forms a recirculating fluidic circuit that releases ions into the gas flow drawn from the smoking space;

wherein the gas flow drawn from the smoking space is pumped through the mixing chamber;

wherein the ion generator processes a gas subflow that is drawn from the gas flow as it passes through the mixing chamber;

wherein the ion generator passes ultraviolet light through the gas subflow;

wherein the ion generator releases the processed gas subflow back into the mixing chamber.

2. The apparatus according to claim 1 wherein the smoking space comprises an enclosed space, an entrance, a plurality of intake stanchions, and a raised floor;

wherein the enclosed space physically contains the smoke generated by the cigarette within the smoking space;

wherein the entrance is a door that allows for access into and out of the enclosed space;

wherein each of the plurality of intake stanchions is further defined with a lateral face;

wherein the raised floor is a horizontal surface positioned above a supporting surface;

wherein the raised floor creates a space between the supporting surface and the smoking space in which the air handling system is contained.

3. The apparatus according to claim 2 wherein the lateral face of each of the plurality of intake stanchions forms a foraminous surface through which gas from the enclosed space flows;

wherein each of the plurality of intake stanchions forms a pipe through which gas is drawn from the smoking space into the air handling system.

4. The apparatus according to claim 3 wherein the plurality of fans comprises an intake fan, a recirculation fan, a mixing fan, and an exhaust fan;

wherein the intake fan and the recirculation fan pumps a gas flow from the enclosed space through the filter chain;

wherein the mixing fan draws fresh air into the smoking space through the air intake;

wherein the exhaust fan discharges air from the smoking space into the atmosphere.

5. The apparatus according to claim 4 wherein the intake fan is a mechanical device that initiates the gas flow from the enclosed space by pumping gas from the plurality of intake stanchions into the activated carbon filter;

wherein the recirculation fan is a mechanical device that generates the recirculation of the gas subflow between the mixing chamber and the ion generator;

wherein the mixing fan is a mechanical device that draws a processed gas flow from the zeolite filter;

wherein the mixing fan draws fresh air into the system from the air intake;

wherein the mixing fan pumps the combination of the processed gas flow and the drawn fresh air back into the enclosed space;

wherein the exhaust fan pumps gas from the enclosed space to the air exhaust where it discharges into the atmosphere.

6. The apparatus according to claim 5 wherein the air handling system further comprises a first connection, a second connection, a third connection, a fourth connection, a fifth connection, a sixth connection, a seventh connection, an eighth connection, a ninth connection, a tenth connection, an eleventh connection, and a twelfth connection.

7. The apparatus according to claim 6 wherein the first connection fluidly connects each of the plurality of intake stanchions to the intake fan;

wherein the second connection fluidly connects the intake fan to the activated carbon filter;

wherein the third connection fluidly connects the activated carbon filter to the mixing chamber;

wherein the fourth connection fluidly connects the mixing chamber to the recirculation fan;

wherein the fifth connection fluidly connects the recirculation fan to the ion generator;

wherein the sixth connection fluidly connects the ion generator to the mixing chamber to complete the recirculation loop;

wherein the seventh connection fluidly connects the mixing chamber to the zeolite filter;

wherein the eighth connection fluidly connects the zeolite filter to the mixing fan;

wherein the ninth connection fluidly connects the air intake to the mixing fan;

wherein the tenth connection fluidly connects the mixing fan to the enclosed space;

wherein the eleventh connection fluidly connects the enclosed space to the exhaust fan;

wherein the twelfth connection fluidly connects the exhaust fan to the air exhaust;

wherein each of the plurality of walls of the enclosed space is comprised of a plurality of wall panels;

wherein each of the plurality of wall panels includes a plurality of panel holes thereon;

wherein the plurality of panel holes enables fresh air from outside of the smoking space to enter the enclosed space.

8. The chamber and apparatus according to claim 1 wherein the plurality of fans comprises an intake fan, a recirculation fan, a mixing fan, and an exhaust fan;

wherein the intake fan and the recirculation fan pumps a gas flow from the smoking space through the filter chain;

wherein the mixing fan draws fresh air into the smoking space through the air intake;

wherein the exhaust fan discharges air from the smoking space into the atmosphere.

9. The apparatus according to claim 8 wherein the intake fan is a mechanical device that initiates the gas flow drawn from the smoking space by pumping gas from a plurality of intake stanchions into the activated carbon filter;

wherein the recirculation fan is a mechanical device that generates the recirculation of the gas subflow between the mixing chamber and the ion generator;

wherein the mixing fan is a mechanical device that draws a processed gas flow from the zeolite filter;

wherein the mixing fan draws fresh air into the system from the air intake;

wherein the mixing fan pumps the combination of the processed gas flow and the drawn fresh air back into the smoking space;

wherein the exhaust fan pumps gas from the smoking space to the air exhaust where it discharges into the atmosphere.

10. The apparatus according to claim 9 wherein the air handling system further comprises a first connection, a second connection, a third connection, a fourth connection, a fifth connection, a sixth connection, a seventh connection, an eighth connection, a ninth connection, a tenth connection, an eleventh connection, and a twelfth connection;

wherein the first connection fluidly connects each of the plurality of intake stanchions to the intake fan;

wherein the second connection fluidly connects the intake fan to the activated carbon filter;

wherein the third connection fluidly connects the activated carbon filter to the mixing chamber;

wherein the fourth connection fluidly connects the mixing chamber to the recirculation fan;

wherein the fifth connection fluidly connects the recirculation fan to the ion generator;

wherein the sixth connection fluidly connects the ion generator to the mixing chamber to complete the recirculation loop;

wherein the seventh connection fluidly connects the mixing chamber to the zeolite filter;

wherein the eighth connection fluidly connects the zeolite filter to the mixing fan;

wherein the ninth connection fluidly connects the air intake to the mixing fan;

wherein the tenth connection fluidly connects the mixing fan to the enclosed space;

wherein the eleventh connection fluidly connects the enclosed space to the exhaust fan;

wherein the twelfth connection fluidly connects the exhaust fan to the air exhaust.

11. The apparatus according to claim 10 wherein the smoking space comprises an enclosed space, an entrance, a plurality of intake stanchions, and a raised floor;

wherein the enclosed space physically contains the smoke generated by the cigarette within the smoking space;

wherein the entrance is a door that allows for access into and out of the enclosed space;

wherein each of the plurality of intake stanchions is further defined with a lateral face;

wherein the raised floor is a horizontal surface positioned above a supporting surface;

wherein the raised floor creates a space between the supporting surface and the smoking space in which the air handling system is contained;

wherein the lateral face of each of the plurality of intake stanchions forms a foraminous surface through which gas from the enclosed space flows;

wherein each of the plurality of intake stanchions forms a pipe through which gas is drawn from the smoking space into the air handling system;

wherein each of the plurality of walls of the enclosed space is comprised of a plurality of wall panels;

wherein each of the plurality of wall panels includes a plurality of panel holes thereon;

wherein the plurality of panel holes enables fresh air from outside of the smoking space to enter the enclosed space.

* * * * *